US005318407A

United States Patent [19]

Davis

[11] Patent Number: 5,318,407

[45] Date of Patent: Jun. 7, 1994

[54] CHECK VALVE HAVING INTERNAL FLOAT

[75] Inventor: Stephen H. Davis, Lawrenceburg, Ind.

[73] Assignee: Foppe Thelen Group, Inc., Cincinnati, Ohio

[21] Appl. No.: 941,749

[22] Filed: Sep. 8, 1992

[51] Int. Cl.[5] ..... F04B 21/02

[52] U.S. Cl. ..... 417/12; 417/43; 417/295; 417/297.5; 417/300; 137/399; 137/516.25; 137/539

[58] Field of Search ..... 417/295, 297.5, 300, 417/557, 12, 43, 423.3; 137/516.25, 399, 539, 192

[56] References Cited

U.S. PATENT DOCUMENTS

| | | | |
|---|---|---|---|
| 1,784,720 | 12/1930 | Boynton | 137/516.25 |
| 1,831,318 | 11/1931 | O'Neil et al. | 137/399 |
| 1,865,387 | 6/1932 | Radomski | 137/399 |
| 1,883,190 | 10/1932 | Welcker . | |
| 2,136,263 | 11/1938 | Holmes . | |
| 2,162,326 | 6/1939 | Cooper . | |
| 2,716,422 | 8/1955 | Whitlock | 137/399 |
| 2,793,652 | 5/1957 | Evans | 137/399 |
| 2,953,659 | 9/1960 | Edwards | 417/43 |
| 3,072,059 | 1/1963 | Heffel | 417/43 |
| 3,174,437 | 3/1965 | Street . | |
| 3,202,174 | 8/1965 | Rudelick | 137/399 |
| 3,410,217 | 11/1968 | Kelley et al. | 417/295 |
| 3,709,636 | 1/1973 | Rosenberg | 417/12 |
| 3,969,605 | 7/1976 | Danell . | |
| 4,119,865 | 10/1978 | Elderton | 417/43 |
| 4,243,102 | 1/1981 | Elfarr | 417/118 |
| 4,390,061 | 6/1983 | Short | 417/108 |
| 4,507,053 | 3/1985 | Frizzell | 417/43 |
| 4,625,807 | 12/1986 | Harlow | 417/138 |
| 5,065,791 | 11/1991 | Miller et al. . | |

*Primary Examiner*—Richard A. Bertsch
*Assistant Examiner*—Roland G. McAndrews
*Attorney, Agent, or Firm*—Killworth, Gottman, Hagan and Schaeff

[57] ABSTRACT

The present invention provides a check valve which, when placed at the end of a pump suction pipe, allows the pump to draw fluid therethrough from a continuously replenished, below-ground fluid source. When the fluid in the fluid source has been depleted to a level below that which allows fluid to be drawn therefrom by the pump, the present check valve maintains the suction pipe full of fluid. The check valve also maintains the suction pipe full of fluid when the pump has been shut off. In this manner, the pump can resume drawing fluid from the fluid source without the need for priming.

17 Claims, 7 Drawing Sheets

CHECK VALVE HAVING INTERNAL FLOAT

BACKGROUND OF THE INVENTION

The present invention relates to a check valve and, more particularly, to one which, when placed on a pump suction pipe, allows the pump to draw fluid intermittently from a fluid source located below the level of the pump, without the necessity of priming the pump each time the pump is started.

In many instances, it is desired to remove fluid over an extended period of time from a below-ground fluid source which is continually replenished, such as a well or sump. A convenient and economical means for removing such fluid is to position a pump on ground level just outside of the fluid source and lower a suction pipe, attached to the pump suction port, into the fluid source. Each time the fluid in the fluid source rises to a predetermined level, the pump is switched on to draw the fluid up and out of the fluid source. When the fluid level has been drawn down below the level of the suction pipe inlet, the pump is switched off.

As an example of the foregoing, when a portion of the soil becomes contaminated, a technique known as soil vacuum extraction may be used to clean up the affected area. In accordance with this technique, a number of wells are dug at the affected site. The purpose for these wells is to collect contaminated ground water and rainwater as it percolates through the contaminated soil. The wells fill with contaminated water and are pumped dry, or down to any desired level, on a continuous basis. The contaminated water is collected and treated to remove the contaminants therefrom. This cycle continues until all, or substantially all, of the contaminants are removed from the affected site.

As another example, bacteria are sometimes placed into the soil at contaminated soil sites to ingest the contaminant. To keep the bacteria viable, they must be supplied with replenishment fluids on a continuous basis. Because the replenishment fluids can become contaminated, wells are dug at the affected site to collect the fluids. As with the previous example, the wells are continually pumped as they fill with the replenishment fluids so that the fluids can be collected and treated.

As a further example, containments are often used to prevent contaminated fluids from escaping a contained area, such as a landfill. In the case of a landfill, a containment may take the form of a berm or dam which encircles the landfill. One or more sumps may be placed between the landfill and the containment to collect any runoff rainwater or other fluids. As the sumps fill with contaminated fluid, they are pumped dry or nearly so on a continuous basis so that the collected fluid can be removed and treated.

With known pumping arrangements, once the fluid in the fluid source has been pumped down to a level below that of the suction pipe inlet, all of the remaining fluid in the pump suction pipe will either be drawn into the pump or will fall back into the fluid source due to a vacuum break in the suction pipe. When this situation occurs, the pump must be primed before pumping can be resumed as required (i.e. when the fluid level has risen above the suction pipe inlet). Pump priming involves filling the pump and suction pipe with fluid prior to starting the pump.

The continual loss of pump prime and the resultant necessity to re-prime the pump prior to each pump start greatly encumbers the removal of fluids from continuously replenished fluid sources. In the first place, pump priming is generally a manual operation. Although self-priming pumps exist, they typically do not possess sufficient priming capability to be of use in the removal of fluids from below-ground fluid sources. Thus, the removal operation cannot be automated. Instead, vigilant surveillance and frequent manipulation of the pumping operation is needed. When the level of fluid in the fluid source has been pumped down below the level of the suction pipe inlet (such that fluid is no longer being drawn into the pump), the pump must be shut off soon thereafter to avoid damage thereto. Surveillance is further needed to ensure that the pump is primed and switched on again at the appropriate time. Fluid removal operations from wells, sumps, and the like frequently take place at remote sites. Thus, the manual presence and involvement necessitated by the continuous loss of pump prime is quite burdensome, as well as inefficient. It would be highly desirable to be able to automate such fluid removal processes Accordingly, it is seen that a need exists in the art for a means of removing fluids from a continuously replenished, below-ground fluid source which will maintain the prime of a pump positioned outside the fluid source so that the pump can be stopped and started without having to be primed each time. Such means would allow such fluid removal operations to be automated.

SUMMARY OF THE INVENTION

That need is met by a check valve constructed according to the present invention which, when connected to the end of a pump suction pipe, allows the pump to draw fluid therethrough from a continuously replenished, below-ground fluid source. When the fluid in the fluid source has been depleted to a level below that which allows fluid to be drawn from the source by the pump, the check valve maintains the suction pipe full of fluid. The check valve also maintains fluid in the suction pipe when the pump has been shut off. In this manner, the pump can thereafter resume drawing fluid from the fluid source without the need for priming.

The check valve comprises a housing which defines an internal chamber through which fluid flows when the pump draws fluid through the check valve. The internal chamber has a top portion and a bottom portion. The check valve further comprises a fluid inlet to the internal chamber located at the top portion of the internal chamber, and a fluid outlet from the internal chamber located at the bottom portion of the internal chamber. The outlet fluidly communicates with the suction pipe. The check valve additionally comprises float means for preventing air from being drawn into the suction pipe when the level of fluid in the fluid source is such that fluid is no longer drawn through the check valve, and for preventing fluid from flowing out of the suction pipe and into the fluid source when the pump has ceased operating. In this manner, the suction pipe is maintained substantially full of fluid when the pump ceases operating so that the pump can subsequently resume operating without the need for priming.

Preferably, the float means includes a lower float seat positioned at the bottom portion of the internal chamber. The lower float seat contains a central opening which defines the outlet from the internal chamber. The float means may further include a float contained within the internal chamber. Preferably, the float has a specific gravity which is less than that of the fluid drawn from the fluid source and is sized such that the float is suspended in the internal chamber between the inlet and the outlet when the pump draws fluid through the check valve, thereby allowing the fluid to flow through the internal chamber and into the suction pipe. Further, the float is capable of seating on the lower float seat when all fluid has been drawn from the internal chamber such that a substantially air-tight seal is formed against the lower float seat by the float. As a consequence, air is prevented from being drawn into the suction pipe when the level of fluid in the fluid source is such that fluid is no longer drawn through the check valve.

The float means may further include an upper float seat positioned at the top portion of the internal chamber. Preferably, the upper float seat has a central opening to define the inlet, and the float is capable of seating against the upper float seat to form a substantially fluid-tight seal such that, when the pump ceases operating, the weight of the fluid in the suction pipe causes the fluid to flow through the outlet and into the check valve, thereby forcing the float against the upper float seat to form a substantially fluid-tight seal. In this manner, the fluid is prevented from flowing out of the suction pipe and into the fluid source when the pump has ceased operating so that the pump can subsequently resume operating without the need for priming.

The present invention provides three embodiments of the check valve. In accordance with the first embodiment, the check valve is adapted to be positioned within a fluid source such that the inlet fluidly communicates with the fluid in the fluid source when the level of the fluid is above that of the inlet. In accordance with the second embodiment, the check valve is also adapted to be positioned within a fluid source but further includes an inlet pipe to receive the fluid from the fluid source at a level which is below that of the inlet to the check valve. The inlet pipe has a first end, attached to the inlet of the check valve, and a second end, into which the fluid flows, extending downwardly to a level which is below that of the inlet. Thus, the inlet to the check valve communicates with the fluid in the fluid source when the level of the fluid in the fluid source is above that of the second end. Preferably, the inlet pipe defines an internal volume which is less than that of the internal chamber of the check valve. In this manner, the fluid source can be pumped down to a level which is below that of the inlet to the check valve. At the same time, by making the internal volume of the inlet pipe smaller than that of the internal chamber, the amount of air ingested by the internal chamber upon start-up (equal to the internal volume of the inlet pipe) will be small enough, as compared to the volume of the internal chamber, that the float will not be made to prematurely seat on the lower float seat.

In the third embodiment, the check valve is adapted to be positioned outside of the fluid source and includes an inlet pipe to receive the fluid from the fluid source at a level which is below that of the inlet to the check valve. The inlet pipe has a first end, attached to the inlet to the check valve, and a second end, into which the fluid flows, extending downwardly into the fluid source to a level which is below that of the inlet to the check valve. As with the second embodiment, the inlet to the check valve communicates with the fluid in the fluid source when the level of the fluid in the fluid source is above that of the second end. Preferably, the internal volume of the inlet pipe is less than that of the internal chamber. This feature allows the check valve to be placed outside of the fluid source without causing the float to prematurely seat (due to excess air ingestion into the internal chamber) upon start-up of the pump.

These and other objects and advantages of the present invention will become apparent from the following detailed description, the accompanying drawings, and the appended claims.

DETAILED DESCRIPTION OF THE PREFERRED EMBODIMENTS

Figure 1:
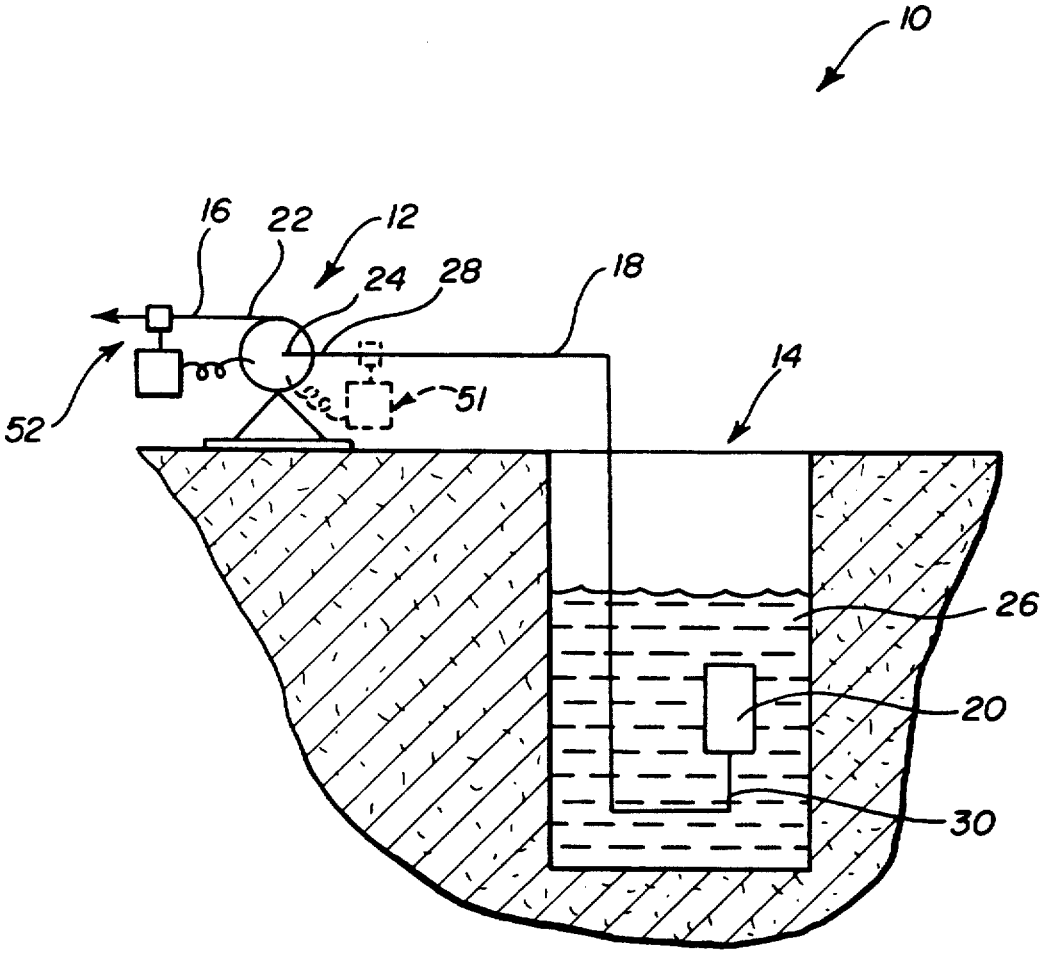
FIG. 1 is a schematic view of the check valve of the present invention positioned in a well, and connected to a pump by a suction line.

Referring to FIGS. 1–4, but particularly to FIG. 1, a system 10 for removing fluid from a fluid source is shown including pump 12, discharge pipe 16, suction pipe 18, and check valve 20. Pump 12, positioned outside of well 14, has a discharge port 22 and a suction port 24. Discharge pipe 16 is fluidly connected to discharge port 22. Fluid 26, containing contaminants and drawn from well 14 by pump 12, is discharged from pump 12 via discharge port 22 and flows through discharge pipe 16 to a downstream destination, such as a collection tank where fluid 26 is held pending treatment.

Suction pipe 18 has a first end 28 connected to suction port 24 of pump 12, and a second end 30 fluidly connected to check valve 20. In this manner, when pump 12 is made to operate, fluid 26 from well 14 flows through check valve 20 and then through suction pipe 18 before entering pump 12 through suction port 24.

Figure 2:
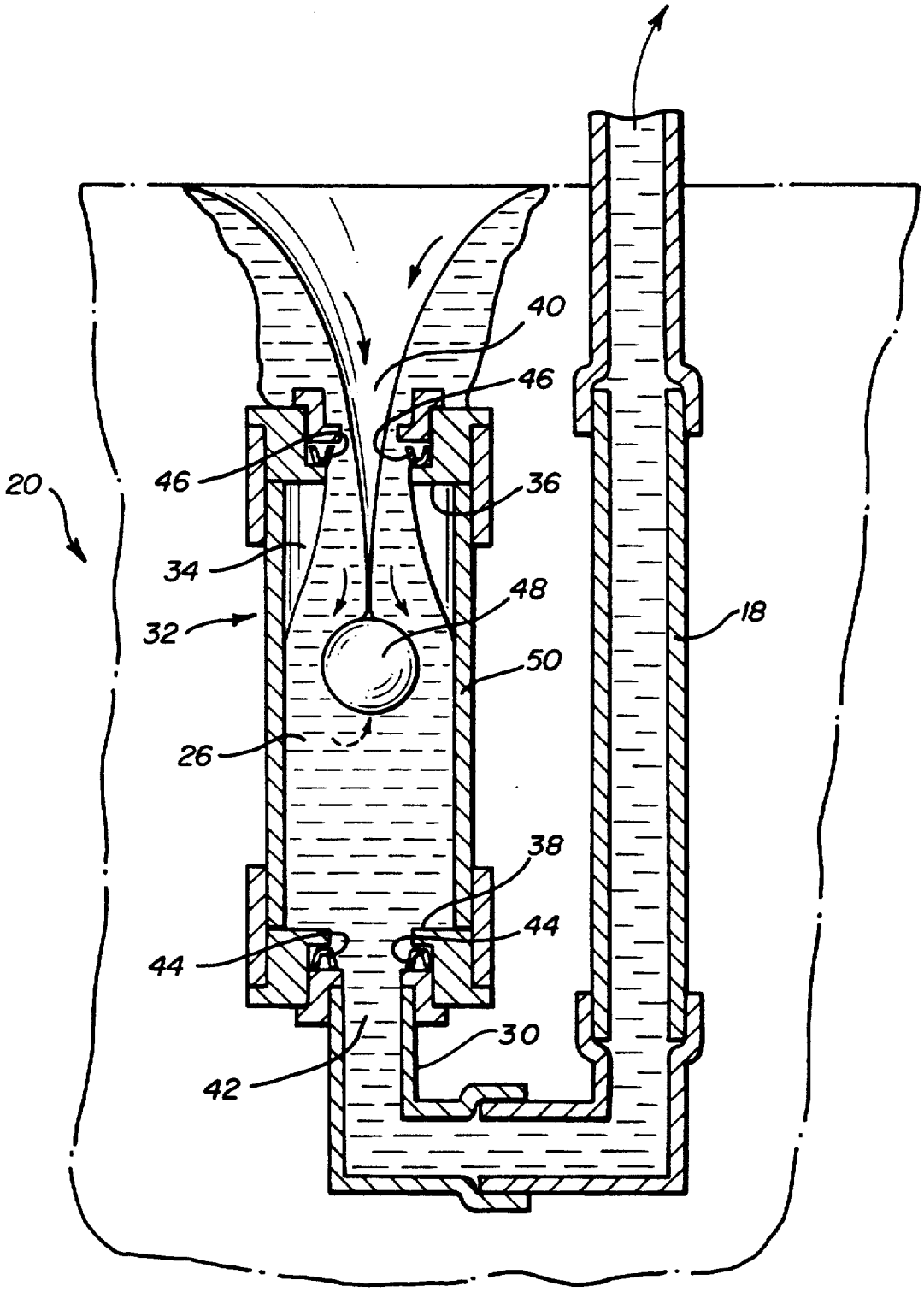
FIG. 2 is a cross-sectional view of the check valve shown in FIG. 1 in which fluid from the well is being drawn into the internal chamber of the check valve.
Figure 3:
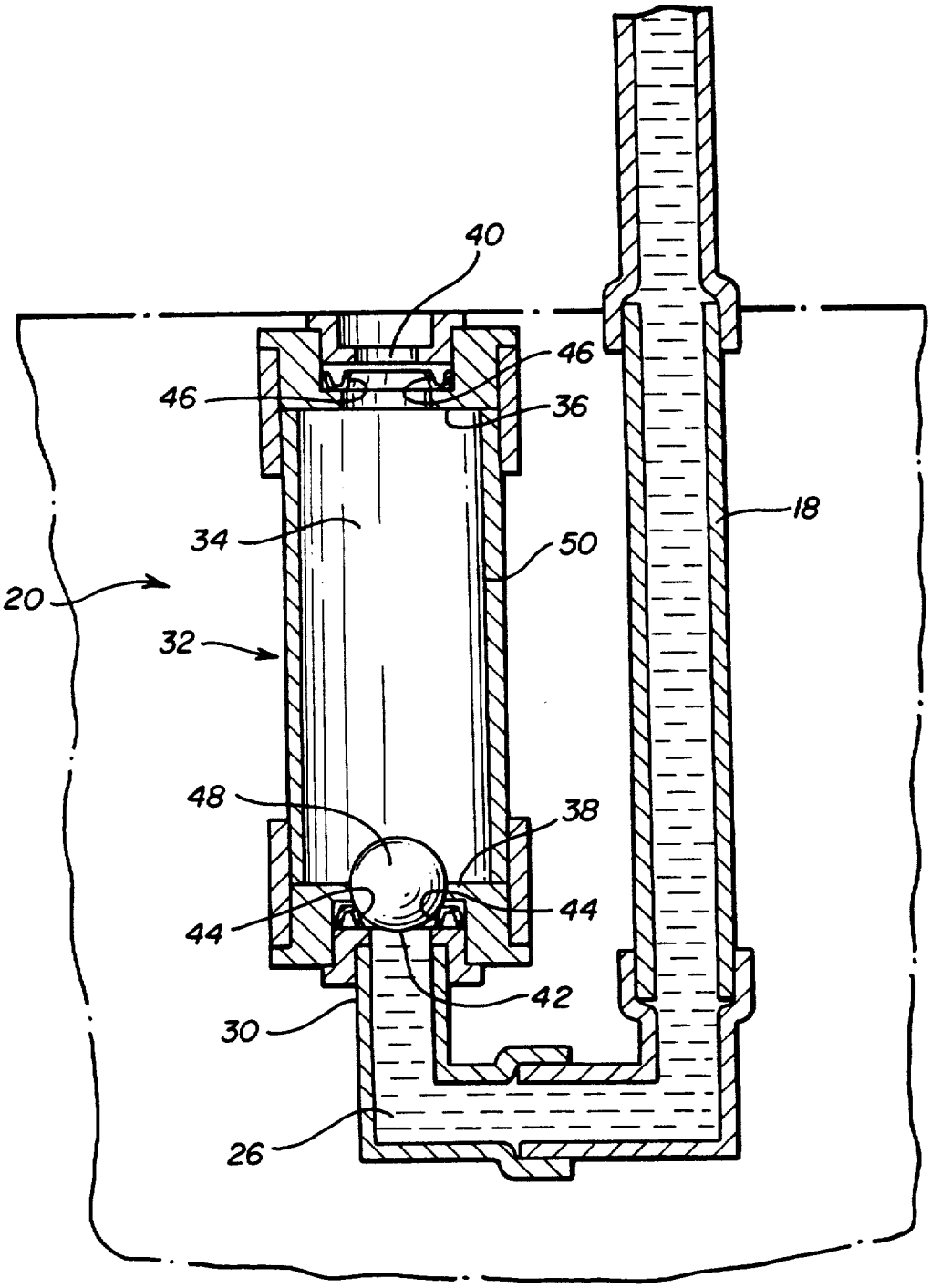
FIG. 3 is a cross-sectional view, similar to FIG. 2, in which all of the fluid has been drawn from the internal chamber of the check valve such that the float is seated on the lower float seat to form an air-tight seal.
Figure 4:
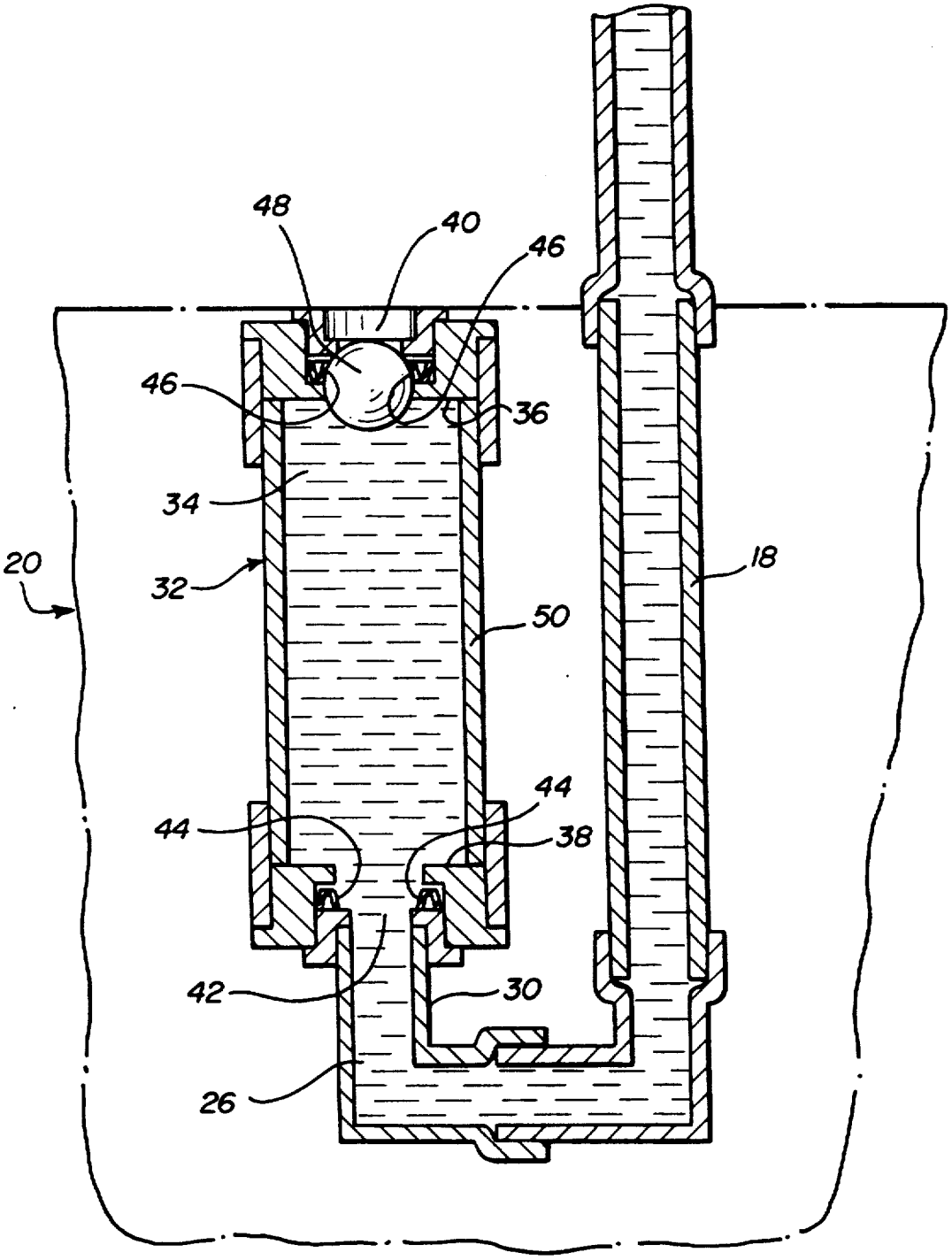
FIG. 4 is a cross-sectional view, similar to FIG. 2, in which the pump has been shut off such that the fluid in the suction line has flowed back into the internal chamber of the check valve and has forced the float against the upper float seat to form a fluid-tight seal.

Check valve 20 is illustrated in greater detail in FIGS. 2–4. As shown, check valve 20 includes housing 32 which defines an internal chamber 34 through which fluid 26 flows when pump 12 draws fluid 26 from well 14. Internal chamber 34 has a top portion 36 and a bottom portion 38. Check valve 20 further includes a fluid inlet 40, located at top portion 36 of internal chamber 34, and a fluid outlet 42, located at bottom portion 38 of internal chamber 34. When pump 12 draws fluid 26 through check valve 20, fluid 26 enters internal chamber 34 through inlet 40, exits internal chamber 34 through outlet 42, and flows from outlet 42 into suction pipe 18.

Preferably, check valve 20 includes float means for preventing air from being drawn into suction pipe 18 when the level of fluid 26 in well 14 is such that fluid 26 is no longer drawn through check valve 20, and for preventing fluid 26 from flowing out of suction pipe 18 and into well 14 when pump 12 has ceased operating. In this manner, suction pipe 18 is maintained substantially full of fluid 26 when pump 12 ceases operating so that pump 12 can subsequently resume operating without the need for priming. As illustrated in FIGS. 2–4, such float means includes lower float seat 44, positioned at bottom portion 38 of internal chamber 34, upper float seat 46, positioned at top portion 36 of internal chamber 34, and float 48, contained within internal chamber 34. Lower float seat 44 contains a central opening which defines outlet 42. Similarly, upper float seat 46 has a central opening which defines inlet 40.

Preferably, float 48 has a specific gravity which is less than that of fluid 26 (or of any fluid drawn through check valve 20) and is sized such that it is suspended in internal chamber 34 between inlet 40 and outlet 42 when pump 12 draws fluid through check valve 20. In this manner, fluid 26 is allowed to flow through internal chamber 34 and into suction pipe 18. As illustrated in FIG. 2, although float 48 is buoyant in fluid 26, the force exerted by fluid 26 on float 48, as fluid 26 is drawn into internal chamber 34 by pump 12, causes float 48 to be suspended in internal chamber 34 between upper float seat 46 and lower float seat 44. Thus, the upward buoyant force on float 48 is offset by the downward force of fluid 26 flowing over float 48. Float 48 and internal chamber 34 are sized such that float 48 will remain suspended above lower float seat 44 during the highest expected flow rate of fluid 26 through check valve 20. Thus, sufficient distance must be provided between float 48 and sidewall 50 of internal chamber 34 that fluid 26 can flow around float 48 without forcing float 48 against lower float seat 44, thereby blocking the flow of fluid 26 through check valve 20. For example, it has been found that if float 48 has a diameter of one inch, and internal chamber 34 has a diameter of two inches, sufficient clearance is provided to accommodate most flow rates of an aqueous based fluid.

After the level of fluid 26 in well 14 has been pumped down to the level of inlet 40 such that fluid 26 no longer flows into internal chamber 34, the amount of fluid 26 in internal chamber 34 will quickly decrease as it is drawn into suction pipe 18 by pump 12. As this occurs, float 48, being buoyant in fluid 26, resides at the surface of fluid 26 in internal chamber 34 until it is deposited on lower float seat 44. As shown in FIG. 3, float 48 is capable of seating on lower float seat 44 when fluid 26 has been drawn from internal chamber 34, causing a substantially air-tight seal to be formed against lower float seat 44 by float 48. Specifically, float 48 and lower float seat 44 are sized such that the vacuum on float 48, created by pump 12 when fluid 26 has been drawn from internal chamber 34, forces float 48 against lower float seat 44 in such a manner that substantially no air passes through outlet 42 and into suction pipe 18. As a consequence, suction pipe 18 is maintained full of fluid 26 even though pump 12 may continue to run.

System 10 preferably includes means to control operation of pump 12. As shown in FIG. 1, such control means preferably includes flow sensing apparatus 52, positioned on discharge pipe 16. Flow sensing apparatus 52 detects the flow rate of fluid 26 discharged from pump 12 as it flows through discharge pipe 16. Flow sensing apparatus 52 can also be positioned on suction pipe 18, shown in phantom at 51 to measure the flow rate of fluid flowing into pump 12. Flow sensing apparatus 52 is electrically linked to the power supply for pump 12 and causes pump 12 to cease operating when the flow rate falls below a predetermined value. Normally, this predetermined value will be a flow rate of zero. In this manner, pump 12 is turned off immediately after the level of fluid 26 in well 14 has been drawn down to the level of inlet 40 such that fluid 26 no longer flows through suction pipe 18 (due to the air-tight seating of float 48 against lower float seat 44 after fluid 26 has been drained from internal chamber 34). As a result, wear and tear on pump 12 is minimized and energy is conserved.

Preferably, flow sensing apparatus 52 further includes means for causing pump 12 to resume operating upon the occurrence of a predetermined event. Such predetermined event may be an increase in the level of fluid 26 in well 14, and may be detected by a level sensor or other means. Alternatively, the predetermined event may be the end of a predetermined interval of time which has elapsed since pump 12 was last shut-off by flow sensing apparatus 52. The predetermined interval can be timed by a timing device. The timing device can be electrically linked to the power supply to pump 12 such that it causes power to be supplied to pump 12 after the predetermined interval has elapsed. The predetermined interval is selected by the operator of system 10, and preferably coincides with the rate at which the level of fluid 26 in well 14 is expected to rise. In this manner, when pump 12 is re-started by the timing device, the level of fluid 26 in well 14 will be above the level of inlet 40.

Alternatively, the control means may include a timing apparatus, electrically linked to pump 12, which causes pump 12 to alternately operate and cease operating at predetermined intervals of time. Such predetermined intervals are selected by the operator of system 10, and are based upon the rate at which well 14 fills with fluid. Thus, the faster well 14 fills with fluid, the shorter will be the intervals of time between the start-up and shut-down of pump 12. Preferably, the intervals are carefully selected such that pump 12 will be shut off soon after the level of fluid in well 14 has been drawn down to the level of inlet 40. Such careful selection will minimize the periods during which pump 12 operates with no fluid flowing therethrough (due to the air-tight seating of float 48 against lower float seat 44 after fluid 26 has been drained from internal chamber 34), thereby extending the life of pump 12.

After pump 12 has been shut off by flow sensing apparatus 52, the vacuum force holding float 48 in tight contact with lower float seat 44 ceases. When this occurs, the weight of fluid 26 in suction pipe 18 will cause that fluid to backflow into internal chamber 34 through outlet 42, thereby displacing float 48 from lower float seat 44 and causing float 48 to rise with the increasing fluid level in internal chamber 34. Similarly, if pump 12 is shut off while the level of fluid 26 in well 14 is above the level of inlet 40 such that fluid is flowing through internal chamber 34, the weight of fluid 26 in suction pipe 18 will cause that fluid to backflow into internal chamber 34 via outlet 42. Pump 12, or a reservoir of fluid fluidly connected with discharge pipe 16, is placed at a higher elevation than upper float seat 46 so that gravity, acting on fluid 26 in suction pipe 18, will cause fluid 26 to backflow into internal chamber 34 and up into top portion 36 to force float 48 into contact with upper float seat 46. As shown in FIG. 4, float 48 and upper float seat 46 are sized such that, when they are forced into intimate contact with one another by fluid 26, float 48 seats against upper float seat 46 to form a substantially fluid-tight seal. In this manner, fluid 26 is prevented from flowing out of suction pipe 18 and into well 14 when pump 12 has ceased operating. As a result, pump 12 can subsequently resume operating without the need for priming. Thus, when a control means (e.g. flow sensing apparatus 52 or a timing apparatus) restarts pump 12, pump 12 will immediately begin drawing fluid 26 from well 14 without the need for priming. Consequently, system 10 can be fully automated and left to operate on its own.

Preferably, housing 32 is constructed of clear polyvinyl chloride or any other suitable material. When fluid 26 is an aqueous based fluid, float 48 is preferably constructed of polypropylene. However, any suitable material having a specific gravity less than that of the particular fluid flowing through check valve 20 will suffice.

Three embodiments of check valve 20 are contemplated by the present invention. In accordance with the first embodiment, as shown in FIGS. 1–4, check valve 20 is adapted to be positioned within a fluid source such that inlet 40 communicates with the fluid in the fluid source when the level of the fluid is above that of the inlet. As shown, check valve 20 of this first embodiment is substantially vertically oriented in well 14, and forms a "J" shaped structure when attached to second end 30 of suction pipe 18.

Figure 5:
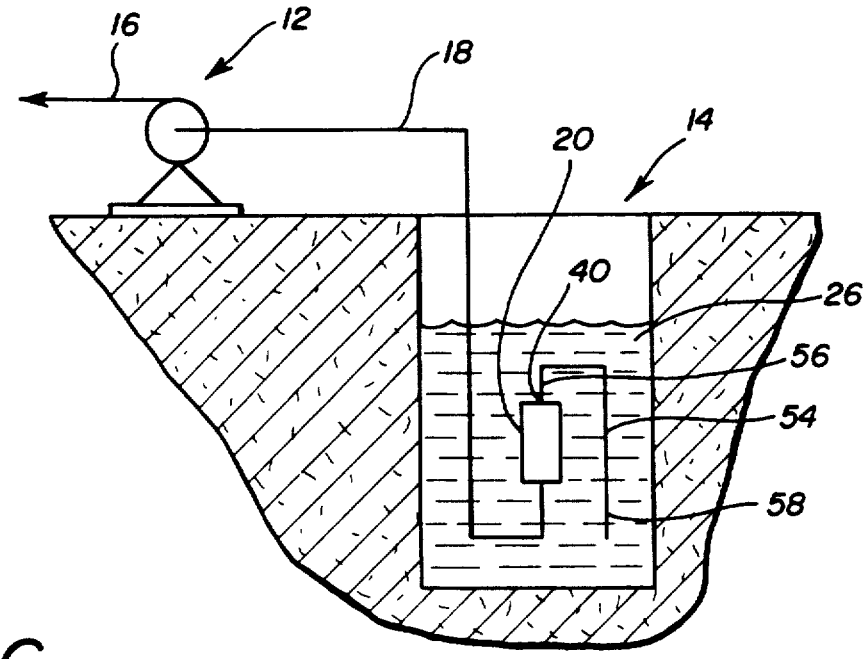
FIG. 5 is a schematic view of a second embodiment of the check valve shown in FIG. 1, in which the check valve includes an inlet pipe attached to the inlet of the check valve.

The second embodiment of check valve 20 is illustrated in FIG. 5. In accordance with this second embodiment, check valve 20 is similarly adapted to be positioned within a fluid source in a substantially vertical orientation, but further includes an inlet pipe 54 to receive the fluid from the fluid source at a level which is below that of inlet 40 to check valve 20. Inlet pipe 54 has a first end 56, attached to inlet 40 of check valve 20, and a second end 58, into which the fluid flows, extending downwardly into the fluid source to a level which is below that of inlet 40. As illustrated, inlet 40 to check valve 20 fluidly communicates with fluid 26 in well 14 only when the level of fluid 26 is above that of second end 58 of inlet pipe 54. In this manner, inlet pipe 54 allows fluid 26 to be drawn down to a level which is below that of inlet 40.

Preferably, inlet pipe 54 defines an internal volume which is less than that of internal chamber 34 of check valve 20. In this manner, the amount of air ingested by internal chamber 34 upon start-up of pump 12 (equal to the internal volume of inlet pipe 54) will be small enough, as compared to the volume of internal chamber 34, that float 48 will not be made to prematurely seat on lower float seat 44.

Figure 6:
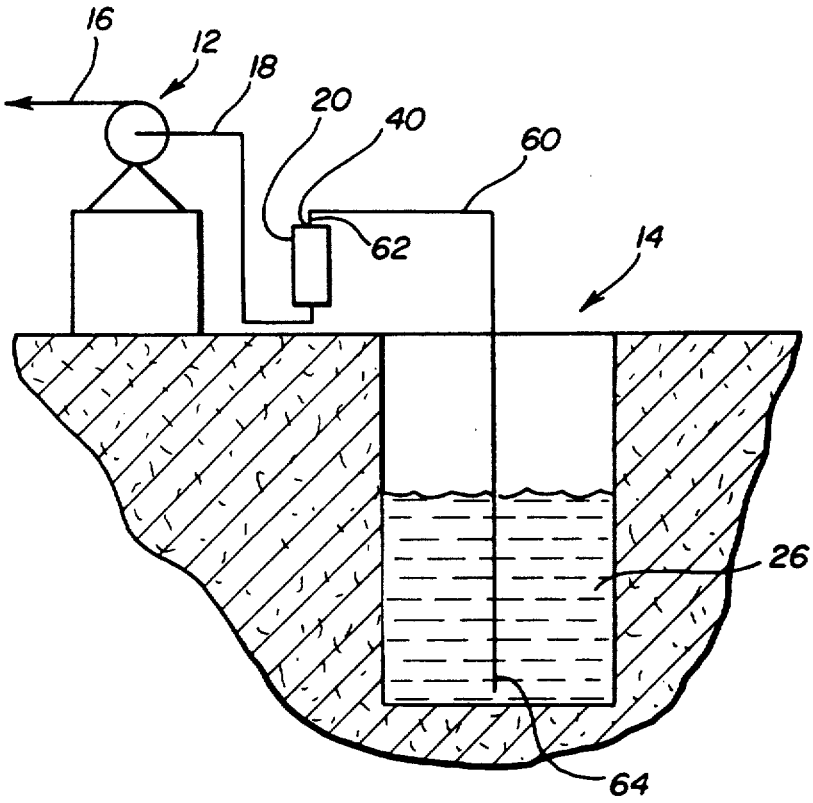
FIG. 6 is a schematic view of a third embodiment of the check valve shown in FIG. 1, in which the check valve is positioned outside of the well and includes an inlet pipe, attached to the inlet of the check valve, extending downward into the well.

Referring now to FIG. 6, the third embodiment of check valve 20 will be described. In accordance with this third embodiment, check valve 20 is adapted to be positioned outside of a fluid source in a substantially vertical orientation, and includes an inlet pipe 60 to receive the fluid from the fluid source at a level which is below that of inlet 40 to check valve 20. Inlet pipe 60 has a first end 62, attached to inlet 40, and a second end 64, into which the fluid flows, extending downwardly into the fluid source to a level which is below that of inlet 40. As illustrated in FIG. 6, inlet 40 to check valve 20 communicates with fluid 26 in well 14 only when the level of fluid 26 is above that of second end 64 of inlet pipe 60. Inlet pipe 60 conveniently allows check valve 20 to be placed outside of well 14. To prevent float 48 from prematurely seating upon lower float seat 44 when pump 12 is restarted (due to excess air ingestion into internal chamber 34), the internal volume of inlet pipe 60 is made less than that of internal chamber 34.

Figure 7:
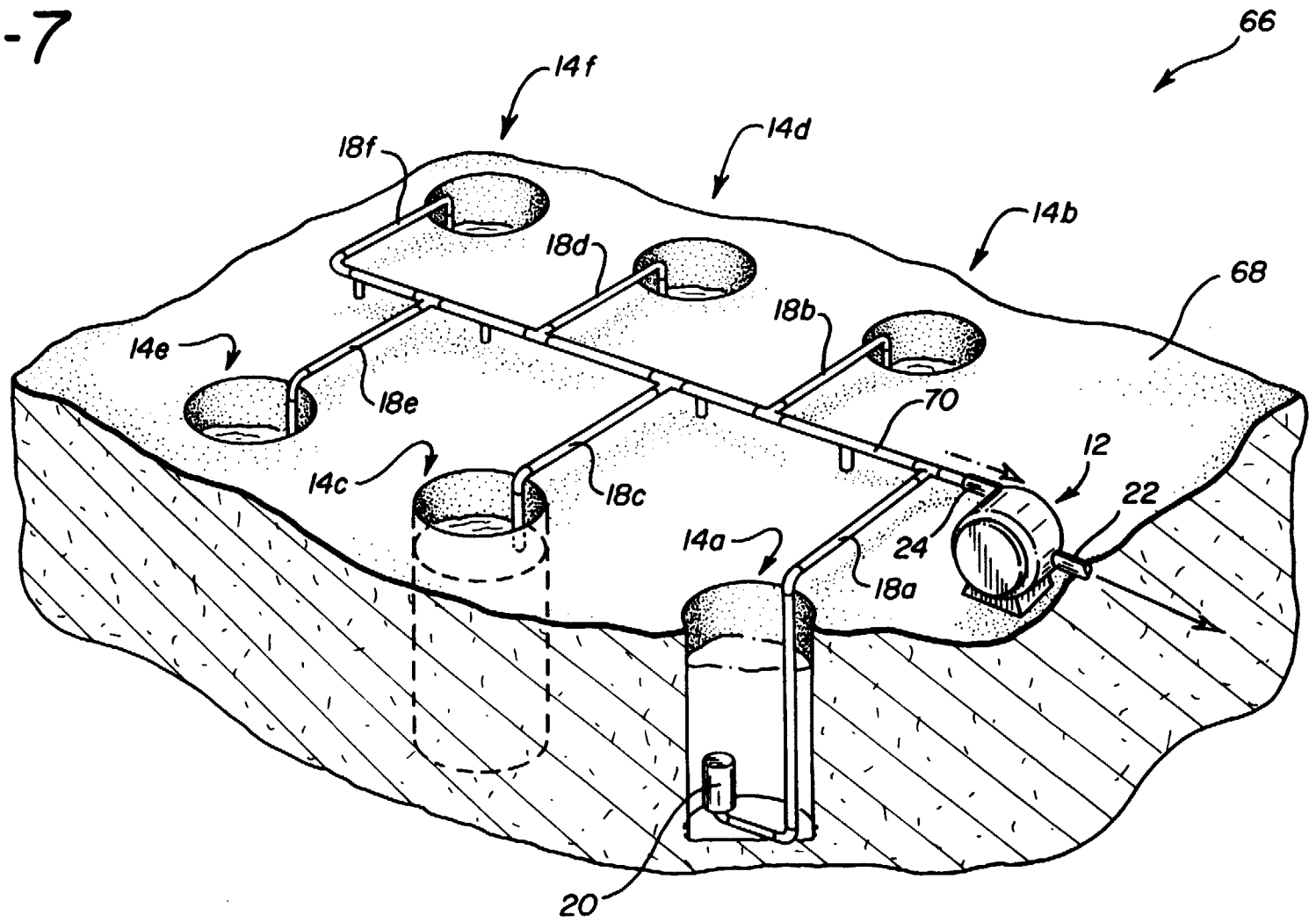
FIG. 7 is a perspective view of a system for removing fluids from multiple wells where a check valve of the present invention is placed into each well at the end of a suction pipe, and all suction pipes lead to the suction port of a single pump.

Referring now to FIG. 7, system 66 will be described. Generally, system 66 illustrates the ability of the present invention to evacuate a multiple number of wells using only one pump. System 66 includes multiple check valves 20, which are connected to a corresponding number of suction pipes 18. Suction pipes 18, in turn, are connected to one pump 12. As illustrated, six wells, 14*a–f*, have been dug in the vicinity of land area 68. Such wells may be used, for example, to remove contaminants from land area 68, or to collect replenishment fluids which have been supplied to bacteria in land area 68. A check valve 20 is placed into each of wells 14*a–f* (only one check valve shown). Each of check valves 20 are connected to one of suction pipes 18*a–f*. Suction pipes 18*a–f* are fluidly connected to manifold pipe 70 which is, in turn, connected to suction port 24 of pump 12. Fluid drawn from wells 14*a–f* by pump 12 is discharged through discharge port 22 and sent to a downstream destination (e.g. a holding tank for subsequent treatment). Although six wells are illustrated in FIG. 7, a greater or lesser number of wells, as desired, can be simultaneously evacuated by one pump through the use of the check valve of the present invention. Further, any of the three embodiments of check valve 20, as described above, can be utilized in system 66.

Although system 66 can be operated manually (by cutting power to pump 12 when all of wells 14*a–f* have evacuated to a level where fluid no longer flows through pump 12), it is preferred that a control means to automatically control operation of pump 12 be utilized. .For example, a flow sensing apparatus can be placed downstream of discharge port 22. As described above, a flow sensing apparatus can be set up to cut power to pump 12 when the flow from pump 12 drops to zero or when the flow drops below some other predetermined value, such as a value corresponding to flow from only one well, or from two wells, etc. As explained above, when power is cut off, suction pipes 18*a–f* will be maintained full of fluid so that when pump 12 is re-started, fluid draw from wells 14*a–f* can resume without the need for priming.

Figure 8:
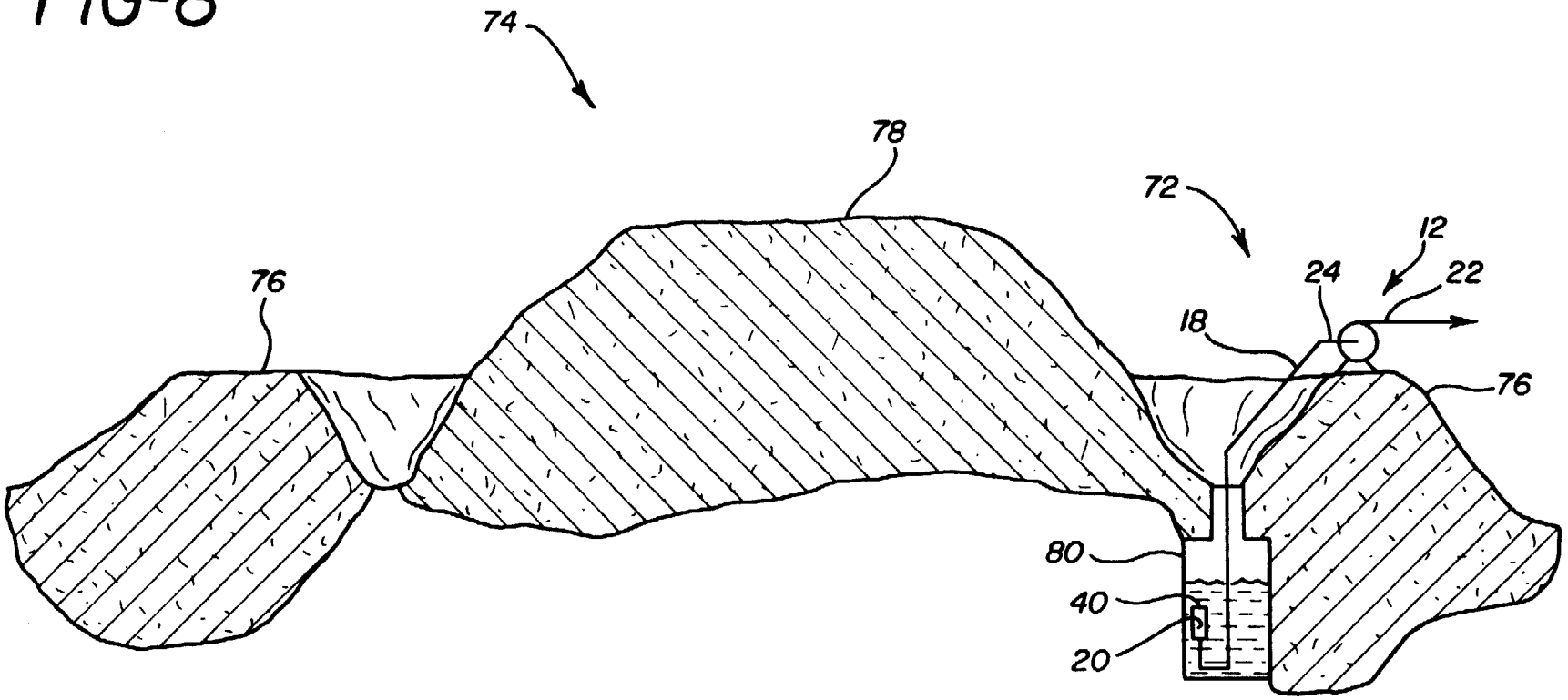
FIG. 8 is a cross-sectional view of a containment berm surrounding a landfill with a sump positioned between the containment berm and the landfill, and a check valve of the present invention is positioned within the sump and communicates with a pump via a suction pipe.

Referring now to FIG. 8, system 72 for the retention and removal of fluids from a containment area 74 will be described. Containment area 74 includes a containment berm 76 which encircles an area to be contained, such as landfill 78. Containment berm 76 prevents fluids, such as contaminated rainwater, etc., from leaving landfill 78. System 72 includes sump 80, positioned within containment area 74 such that fluids flowing within containment area 74 are retained by sump 80. As illustrated, sump 80 is positioned between containment berm 76 and landfill 78. More than one sump may be included as desired. System 72 further includes pump 12, positioned outside of sump 80, check valve 20, and suction pipe 18 fluidly connecting pump 12 with check valve 20. Any of the three embodiments of check valve 20, as described above, can be utilized with system 72.

When the level of fluid in sump 80 is such that the fluid is in fluid communication with inlet 40 and pump 12 is operating, fluid flows through check valve 20 and suction pipe 18, into suction port 24 of pump 12, and out of discharge port 22 to a downstream destination (e.g. a holding tank for treatment). Means, similar to those described above with respect to FIG. 1, are preferably provided to control operation of pump 12. In this manner, the operation of system 72 can be automated.

While representative embodiments and certain details have been shown for purposes of illustrating the invention, it will be apparent to those skilled in the art that various changes in the methods and apparatus disclosed herein may be made without departing from the scope of the invention, which is defined in the appended claims.

What is claimed is:

1. A check valve adapted for use with a pump, said pump and said check valve being fluidly connected by a suction pipe, said pump being adapted to draw fluid through said check valve and said suction pipe from a fluid source, said check valve being adapted to be positioned in said fluid source, said check valve comprising:

a housing defining an internal chamber through which fluid flows when said pump draws fluid through said check valve, said internal chamber having a top portion and a bottom portion;

a fluid inlet to said internal chamber located at said top portion of said internal chamber;

a fluid outlet from said internal chamber located at said bottom portion of said internal chamber, said outlet fluidly communicating with said suction pipe;

float means for preventing air from being drawn into said suction pipe when the level of fluid in said fluid source is such that fluid is no longer drawn through said check valve, and for preventing fluid from flowing out of said suction pipe and into said fluid source when said pump has ceased operating, whereby, said suction pipe is maintained substantially full of fluid when said pump ceases operating so that said pump can subsequently resume operating without the need for priming; and an inlet pipe to receive said fluid from said fluid source at a level which is below that of said inlet to said internal chamber, said inlet pipe defining an internal volume which is less than that of said internal chamber and having a first end attached to said inlet, and a second end, into which said fluid flows, extending downwardly into said fluid source to said level which is below that of said inlet, said inlet fluidly communicating with said fluid in said fluid source when the level of said fluid in said fluid source is above that of said second end.

2. A check valve adapted for use with a pump, said pump and said check valve being fluidly connected by a suction pipe, said pump being adapted to draw fluid through said check valve and said suction pipe from a fluid source, said check valve adapted to be positioned outside of said fluid source, said check valve comprising:

a housing defining an internal chamber through which fluid flows when said pump draws fluid through said check valve, said internal chamber having a top portion and a bottom portion;

a fluid inlet to said internal chamber located at said top portion of said internal chamber;

a fluid outlet from said internal chamber located at said bottom portion of said internal chamber, said outlet fluidly communicating with said suction pipe;

float means for preventing air from being drawn into said suction pipe when the level of fluid in said fluid source is such that fluid is no longer drawn through said check valve, and for preventing fluid from flowing out of said suction pipe and into said fluid source when said pump has ceased operating, whereby, said suction pipe is maintained substantially full of fluid when said pump ceases operating so that said pump can subsequently resume operating without the need for priming; and an inlet pipe to receive said fluid from said fluid source at a level which is below that of said inlet to said internal chamber, said inlet pipe defining an internal volume which is less than that of said internal chamber and having a first end attached to said inlet, and a second end, into which said fluid flows, extending downwardly into said fluid source to said level which is below that of said inlet, said inlet fluidly communicating with said fluid in said fluid source when the level of said fluid in said fluid source is above that of said second end.

3. A system for removing a fluid from a well, comprising:

a pump positioned outside of said well, said pump having a suction port and a discharge port and being adapted to draw said fluid from said well;

means to control operation of said pump;

a discharge pipe fluidly connected to said discharge port, said fluid drawn from said well being discharged from said pump through said discharge port and flowing through said discharge pipe to a downstream destination;

a suction pipe having a first end and a second end, said first end being fluidly connected to said suction port of said pump; and a check valve fluidly connected to said second end of said suction pipe and adapted to be positioned in said well such that said fluid from said well flows through said check valve and said suction pipe and into said suction port when said pump draws said fluid from said well, said check valve comprising, a housing defining an internal chamber through which fluid flows when said pump draws fluid through said check valve, said internal chamber having a top portion and a bottom portion, a fluid inlet to said internal chamber located at said top portion of said internal chamber, a fluid outlet from said internal chamber located at said bottom portion of said internal chamber, said outlet fluidly communicating with said suction pipe, and float means for preventing air from being drawn into said suction pipe when the level of fluid in said well is such that fluid is no longer drawn through said check valve, and for preventing fluid from flowing out of said suction pipe and into said well when said pump has been made to cease operating by said control means, whereby, said suction pipe is maintained substantially full of fluid when said pump ceases operating so that said pump can resume operating without the need for priming; and an inlet pipe to receive said fluid from said well at a level which is below that of said inlet to said internal chamber, said inlet pipe having a first end attached to said inlet, and a second end, into which said fluid flows, extending downwardly into said well to said level which is below that of said inlet, said inlet fluidly communicating with said fluid in said well when the level of said fluid in said well is above that of said second end.

4. A system for removing a fluid from a well, comprising;

a pump positioned outside of said well, said pump having a suction port and a discharge port and being adapted to draw said fluid from said well;

means to control operation of said pump;

a discharge pipe fluidly connected to said discharge pot, said fluid drawn from said well being discharged from said pump through said discharge port and flowing through said discharge pipe to a downstream destination;

a suction pipe having a first end and a second end, said first end being fluidly connected to said suction port of said pump; and a check valve fluidly connected to said second end of said suction pipe and adapted to be positioned outside of said well such that said fluid from said well flows through said check valve and said suction pipe and into said suction port when said pump draws said fluid from said well, said check valve comprising, a housing defining an internal chamber through which fluid flows when said pump draws fluid through said check valve, said internal chamber having a top portion and a bottom portion, a fluid inlet to said internal chamber located at said top portion of said internal chamber, a fluid outlet from said internal chamber located at said bottom portion of said internal chamber, said outlet fluidly communicating with said suction pipe, and float means for preventing air from being drawn into said suction pipe when the level of fluid in said well is such that fluid is no longer drawn through said check valve, and for preventing fluid from flowing out of said suction pipe and into said well when said pump has been made to cease operating by said control means, whereby, said suction pipe is maintained substantially full of fluid when said pump ceases operating so that said pump can resume operating without the need for priming; and an inlet pipe to receive said fluid from said well at a level which is below that of said inlet to said internal chamber, said inlet pipe having a first end attached to said inlet, and a second end, into which said fluid flows extending downwardly into said fluid source to said level which is below that of said inlet, said inlet fluidly communicating with said fluid in said well when the level of said fluid in said well is above that of said second end.

5. A system for the retention and removal of fluids from a containment area, comprising:

a sump positioned within said containment area such that fluids flowing within said containment area are retained by said sump;

a pump, positioned outside of said sump, having a suction port and a discharge port and being adapted to draw fluid from said sump;

means to control operation of said pump;

a discharge pipe fluidly connected to said discharge port, said fluid drawn from said sump being discharged from said pump through said discharge port and flowing through said discharge pipe to a downstream destination;

a suction pipe having a first end and a second end, said first end being fluidly connected to said suction port of said pump; and a check valve fluidly connected to said second end of said suction pipe such that said fluid from said sump flows through said check valve and said suction pipe and into said suction port when said pump draws said fluid from said sump, said check valve comprising, a housing defining an internal chamber through which fluid flows when said pump draws fluid through said check valve, said internal chamber having a top portion and a bottom portion, a fluid inlet to said internal chamber located at said top portion of said internal chamber, a fluid outlet from said internal chamber located at said bottom portion of said internal chamber, said outlet fluidly communicating with said suction pipe, and float means for preventing air from being drawn into said suction pipe when the level of fluid in said sump is such that fluid is no longer drawn through said check valve, and for preventing fluid from flowing out of said suction pipe and into said sump when said pump has been made to cease operating by said control means, whereby, said suction pipe is maintained substantially full of fluid when said pump ceases operating so that said pump can resume operating without the need for priming, said float means comprising, a lower float seat positioned at said bottom portion of said internal chamber, said lower float seat having a central opening to define said outlet, a float contained within said internal chamber, said float having a specific gravity which is less than that of said fluid drawn from said sump and being sized such that said float is freely suspended in said internal chamber between said inlet and said outlet when said pump draws fluid through said check valve, thereby allowing said fluid to flow through said internal chamber and into said suction pipe, said float further being capable of seating on said lower float seat when all fluid has been drawn from said internal chamber such that a substantially air-tight seal is formed against said lower float seat by said float, and an upper float seat positioned at said top portion of said internal chamber, said upper float seat having a central opening to define said inlet, said float being capable of seating against said upper float seat to form a substantially fluid-tight seal such that, when said pump ceases operating, the weight of said fluid in said suction pipe causes said fluid to flow through said outlet and into said check valve, thereby forcing said float against said upper float seat to form said substantially fluid-tight seal.

6. A check valve adapted for use with a pump, said pump and said check valve being fluidly connected by a suction pipe, said pump being adapted to draw fluid through said check valve and said suction pipe from a fluid source, said check valve comprising:

a housing defining an internal chamber through which fluid flows when said pump draws fluid through said check valve, said internal chamber having a top portion and a bottom portion;

a fluid inlet to said internal chamber located at said top portion of said internal chamber;

a fluid outlet from said internal chamber located at said bottom portion of said internal chamber, said outlet fluidly communicating with said suction pipe; and float means for preventing air from being drawn into said suction pipe when the level of fluid in said fluid source is such that fluid is no longer drawn through said check valve, and for preventing fluid from flowing out of said suction pipe and into said fluid source when said pump has ceased operating, whereby, said suction pipe is maintained substantially full of fluid when said pump ceases operating so that said pump can subsequently resume operating without the need for priming, said float means comprising, a lower float seat positioned at said bottom portion of said internal chamber, said lower float seat having a central opening to define said outlet, a float contained within said internal chamber, said float having a specific gravity which is less than that of said fluid drawn from said fluid source and being sized such that said float is freely suspended in said internal chamber between said inlet and said outlet when said pump draws fluid through said check valve, thereby allowing said fluid to flow through said internal chamber and into said suction pipe, said float further being capable of seating on said lower float seat when all fluid has been drawn from said internal chamber such that a substantially air-tight seal is formed against said lower float seat by said float, and an upper float seat positioned at said top portion of said internal chamber, said upper float seat having a central opening to define said inlet, said float being capable of seating against said upper float seat to form a substantially fluid-tight seal such that, when said pump ceases operating, the weight of said fluid in said suction pipe causes said fluid to flow through said outlet and into said check valve, thereby forcing said float against said upper float seat to form said substantially fluid-tight seal.

7. The check valve of claim 6 wherein said check valve is adapted to be positioned in said fluid source such that said inlet fluidly communicates with said fluid in said fluid source when the level of said fluid is above that of said inlet.

8. A system for removing a fluid from a well, comprising:

a pump positioned outside of said well, said pump having a suction port and a discharge port and being adapted to draw said fluid from said well;

means to control operation of said pump;

a discharge pipe fluidly connected to said discharge port, said fluid drawn from said well being discharged from said pump through said discharge port and flowing through said discharge pipe to a downstream destination;

a suction pipe having a first end and a second end, said first end being fluidly connected to said suction port of said pump; and a check valve fluidly connected to said second end of said suction pipe such that said fluid from said well flows through said check valve and said suction pipe and into said suction port when said pump draws said fluid from said well, said check valve comprising, a housing defining an internal chamber through which fluid flows when said pump draws fluid through said check valve, said internal chamber having a top portion and a bottom portion, a fluid inlet to said internal chamber located at said top portion of said internal chamber, a fluid outlet from said internal chamber located at said bottom portion of said internal chamber, said outlet fluidly communicating with said suction pipe, and float means for preventing air from being drawn into said suction pipe when the level of fluid in said well is such that fluid is no longer drawn through said check valve, and for preventing fluid from flowing out of said suction pipe and into said well when said pump has been made to cease operating by said control means, whereby, said suction pipe is maintained substantially full of fluid when said pump ceases operating so that said pump can resume operating without the need for priming, said float means comprising, a lower float seat positioned at said bottom portion of said internal chamber, said lower float seat having a central opening to define said outlet, and a float contained within said internal chamber, said float having a specific gravity which is less than that of said fluid drawn from said well and being sized such that said float is freely suspended in said internal chamber between said inlet and said outlet when said pump draws fluid through said check valve, thereby allowing said fluid to flow though said internal chamber and into said suction pipe, said float further being capable of seating on said lower float seat when all fluid has been drawn from said internal chamber such that a substantially air-tight seal is formed against said lower float seat by said float, and an upper float seat positioned at said top portion of said internal chamber, said upper float seat having a central opening to define said inlet, said float being capable of seating against said upper float seat to form a substantially fluid-tight seal such that, when said pump ceases operating, the weight of said fluid in said suction pipe causes said fluid to flow through said outlet and into said check valve, thereby forcing said float against said upper float seat to form said substantially fluid-tight seal.

9. The system of claim 8 wherein said control means includes a timing apparatus electrically linked to said pump, said timing apparatus causing said pump to alternately operate and cease operating at predetermined intervals of time.

10. The system of claim 8 wherein said control means includes:

a flowing sensing apparatus positioned within said discharge pipe, said flow sensing apparatus detecting the flow rate of said fluid discharged from said pump and causing said pump to cease operating when said flow rate falls below a predetermined value; and means for causing said pump to resume operating upon the occurrence of a predetermined event.

11. The system of claim 8 wherein said control means includes:

a flow sensing apparatus positioned within said suction pipe, said flow sensing apparatus detecting the flow rate of fluid flowing into said suction port of said pump and causing said pump to cease operating when said flow rate falls below a predetermined value; and means for causing said pump to resume operating upon the occurrence of a predetermined event.

12. The system of claim 8 wherein said check valve is adapted to be positioned in said well such that said inlet fluidly communicates with said fluid in said well when the level of said fluid is above that of said inlet.

13. The system of claim 8 further including one or more additional ones of said check valves fluidly connected to one or more additional ones of said suction pipes, said one or more additional suction pipes being fluidly connected to said pump, said one or more additional check valves and one or more additional suction pipes being positioned to allow said pump to draw fluid from one or more additional wells.

14. A system for removing fluid from a plurality of wells, said system comprising:

a pump positioned outside said plurality of wells, said pump having a suction port and a discharge port and being adapted to draw said fluid from said plurality of wells;

a discharge pipe fluidly connected to said discharge port, said fluid drawn from said well being discharged from said pump through said discharge port and flowing through said discharge pipe to a downstream destination;

a manifold pipe having a first end being fluidly connected to said suction port of said pump;

a plurality of suction pipes being fluidly connected to said manifold pipe; and a plurality of check valves, each such check valve being fluidly connected to an associated one of said suction pipe, each of said check valves being positioned with respect to an associated one of said wells such that fluid from each of said wells flows through said associated check valve, said associated suction pipe, said manifold pipe and into said suction port when said pump draws said fluid from said wells, each of said check valves comprises, a housing defining an internal chamber located at said top portion of said internal chamber, a fluid inlet to said internal chamber located at said top portion of said internal chamber, a fluid outlet from said internal chamber located at said bottom portion of said internal chamber, said outlet fluidly communicating with said associated suction pipe, and float means for preventing air from being drawn into said suction pipe when the level of fluid in said well is such that fluid is no longer drawn through said check valve, and for preventing fluid from flowing out of said suction pipe and into said well when the level of fluid in said well is such that fluid is no longer drawn through said check valve, said float means comprising, a lower float seat positioned at said bottom portion of said internal chamber, said lower float seat having a central opening to define said outlet, a float contained within said internal chamber, said float having a specific gravity which is less than that of said fluid drawn from said well and being sized such that said float is suspended in said internal chamber between said inlet and said outlet when said pump draws fluid through said check valve, thereby allowing said fluid to flow through said internal chamber and into said associated suction pipe, said float further being capable of seating on said lower float seat when all fluid has been drawn from said internal chamber such that a substantially air-tight seal is formed against said lower float seat by said float, and an upper float seat positioned at said top portion of said internal chamber, said upper float seat having a central opening to define said inlet, said float being capable of seating against said upper float seat to form a substantially fluid-tight seal such that, when said pump ceases operating, the weight of said fluid in said associated suction pipe causes said fluid to flow through said outlet and into said check valve, thereby forcing said float against said upper float seat to form a substantially fluid-tight seal, so that said pup can subsequently resume operating without the need for priming.

15. The system of claim 14 wherein at least one of said check valves is adapted to be positioned in said associated one of said wells such that said inlet fluidly communicates with said fluid in said well when the level of said fluid is above that of said inlet.

16. The system of claim 14 wherein at least one of said check valves is adapted to be positioned in said fluid source and further includes an inlet pipe to receive said fluid from said associated one of said wells at a level which is below that of said inlet to said check valve, said inlet pipe having a first end attached to said inlet of said check valve, and a second end, into which said fluid flows, extending downwardly into said well to said level which is below that of said inlet, said inlet to said check valve fluidly communicating with said fluid in said well when the level of said fluid in said well is above that of said second end.

17. The system of claim 14 wherein at least one of said check valves is adapted to be positioned outside of said well and further includes an inlet pipe to receive said fluid from said associated one of said wells at a level which is below that of said inlet to said check valve, said inlet pipe having a first end attached to said inlet to said check valve, and a second end, into which said fluid flows extending downwardly into said fluid source to said level which is below that of said inlet to said check valve, said inlet to said check valve fluidly communicating with said fluid in said well when the level of said fluid in said well is above that of said second end.

* * * * *